US006450151B1

(12) United States Patent
Frank et al.

(10) Patent No.: US 6,450,151 B1
(45) Date of Patent: Sep. 17, 2002

(54) FUEL DELIVERY MODULE WITH AN INITIAL FILLING VALVE

(75) Inventors: Kurt Frank, Schorndorf; Ingo Richter, Markgroeningen, both of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/646,821

(22) PCT Filed: Mar. 23, 1999

(86) PCT No.: PCT/DE99/00832

§ 371 (c)(1),
(2), (4) Date: Sep. 22, 2000

(87) PCT Pub. No.: WO99/49207

PCT Pub. Date: Sep. 30, 1999

(30) Foreign Application Priority Data

Mar. 25, 1998 (DE) ..... 198 13 172

(51) Int. Cl.[7] ..... F02M 37/04
(52) U.S. Cl. ..... 123/514; 123/509
(58) Field of Search ..... 123/514, 509; 137/565.22, 565.34, 574, 576, 430, 433, 446

(56) References Cited

U.S. PATENT DOCUMENTS 4,335,741 A * 6/1982 Nasser ..... 137/426
5,218,942 A * 6/1993 Coha et al. ..... 123/514
5,564,397 A * 10/1996 Kleppner et al. ..... 123/514
5,642,719 A * 7/1997 Brown ..... 123/509
6,158,461 A * 12/2000 Frank et al. ..... 137/574
6,273,131 B1 * 8/2001 Kleppner ..... 137/565.22

FOREIGN PATENT DOCUMENTS

DE 195 49 192 A1 7/1997

* cited by examiner

*Primary Examiner*—Willis R. Wolfe
*Assistant Examiner*—Mahmoud Gimie
(74) *Attorney, Agent, or Firm*—Michael J. Striker

(57) ABSTRACT

An apparatus for feeding fuel from a supply container to an internal combustion engine of a motor vehicle is described. The apparatus has a fuel feed unit which on the intake side communicates with a suction container, communicating with the supply container, and on the pressure side communicates with the engine, and having a return line for feeding excess fuel into the suction container. In its bottom region the suction container has a closing element, which is movable between a first position, in which the suction container is opened relative to the supply container, and a second position, in which the suction container is closed relative to the supply container. According to the invention, the closing element has an actuating device, preferably a float body, which in particular at a low or zero fuel level in the supply container keeps the closing element in the first, open position, and which, when at least enough fuel is located in the suction container that the fuel feed unit can still furnish enough fuel to the engine, keeps the closing element in the second, closed position.

7 Claims, 3 Drawing Sheets

FUEL DELIVERY MODULE WITH AN INITIAL FILLING VALVE

Figure 1:
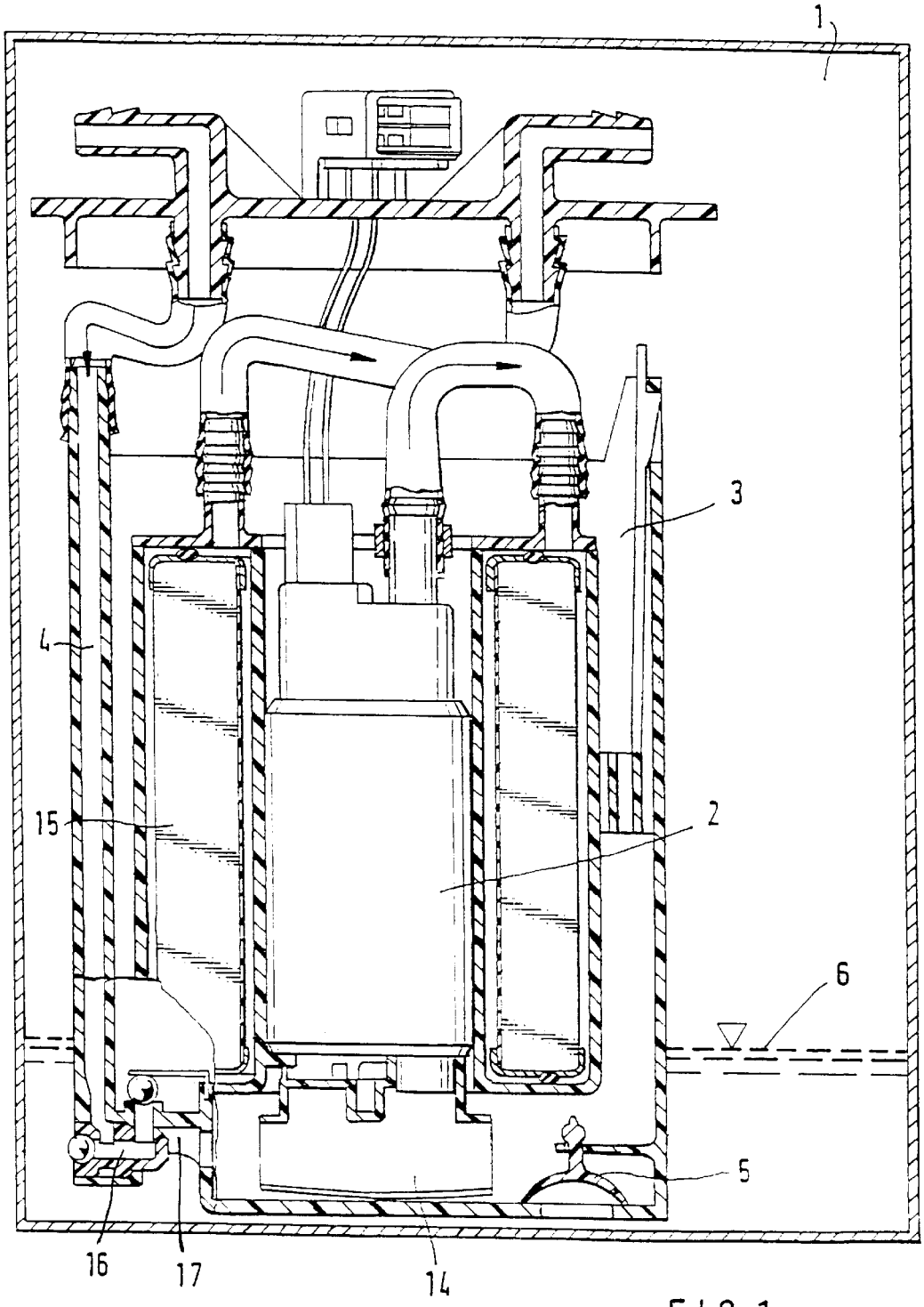
FIG.1 PRIOR ART

The invention relates to an apparatus for feeding fuel from a supply container to an internal combustion engine of a motor vehicle as generically defined by the preamble to claim 1.

PRIOR ART

One such apparatus is known from German Patent Disclosure DE 195 49 192. The fuel feed module described has a mushroom-shaped closing element in the bottom region of its suction container. This closing element is received in axially movable fashion. The mushroomlike part of the closing element spans an opening in the bottom of the suction container of the fuel feed module, by way of which the interior of the suction container of the fuel feed module communicates with the interior of a supply container. By its own weight, the closing element rests on the inside of the bottom of the suction container, spanning the opening, so that the opening is sealingly closed. When fuel is now introduced into the supply container, the fuel level in it rises, and as a result the static pressure acting on the underside of the closing element increases as well. This opens the valve, and fuel flows out of the supply container through the opening in the bottom of the suction container into the interior of the suction container. From the interior of the suction container, the fuel is delivered to the motor vehicle engine by means of a fuel feed module.

So that fuel can be delivered to the engine by the fuel feed unit, it is therefore necessary for relatively large quantities of fuel to be introduced into the supply container, so that an adequately high static pressure can be built up to open the closing element and thus enable the fuel to flow into the interior of the suction container. A disadvantage of an initial-fill valve actuated by the static pressure is thus the relatively large quantity of fuel that must be fed into the supply container in order to actuate the initial-fill valve.

ADVANTAGES OF THE INVENTION

It is therefore the object of the invention to create an apparatus for feeding fuel from a supply container to an internal combustion engine of a motor vehicle which in particular assures reliable initial filling of the fuel feed module after the final assembly of a motor vehicle the first time its tank is filled, or if the supply container has run empty, or only slight fuel quantities are present.

This object is attained by an apparatus having the characteristics of claim 1. Expedient refinements are defined by the dependent claims.

The apparatus according to the invention for feeding fuel from a supply container to an internal combustion engine of a motor vehicle. The apparatus has a fuel feed unit which on the intake side communicates with a suction container, communicating with the supply container, and on the pressure side communicates with the engine, and having a return line for feeding excess fuel into the suction container. In its bottom region the suction container has a closing element, which is movable between a first position, in which the suction container is opened relative to the supply container, and a second position, in which the suction container is closed relative to the supply container. According to the invention, the closing element has an actuating device, preferably a float body, which in particular at a low or zero fuel level in the supply container keeps the closing element in the first, open position, and which when at least enough fuel is located in the suction container so that the fuel feed unit can still furnish enough fuel to the engine, keeps the closing element in the second, closed position.

One essential advantage of a closing element having an actuating device is that the sealing function and closing function of the closing element are decoupled from one another. This kind of closing element according to the invention, also known as an initial-fill valve, is connected to the actuating device in such a way that when the tank is empty, the closing element is opened. Accordingly, for actuating the initial-fill valve, there is no need for a static pressure to be built up. As a result, even when the slightest fuel quantities are introduced, an immediate inflow of fuel from the supply container into the interior of the suction container is assured. A further advantage of a closing element embodied in this way is that when the tank is empty, the initial-fill valve is kept in the open position, so that sticking effects at the sealing seat that would otherwise occur are eliminated. Especially with an actuating device that is controlled as a function of the fuel level in the supply tank, a precisely defined closing point of the closing element is settable or attainable.

In one exemplary embodiment of the invention, the actuating device is embodied as a float body and is connected to the closing element. The closing element is attached to the bottom of the suction container of the fuel feed module in such a way that when no fuel is present, the closing element is located in the open position by its total mass, comprising the mass of the closing element itself and the mass of the float body, since in the absence of fuel the float body is not lent any buoyancy. The float body is dimensioned such that in the event that the float body is immersed in the fuel or surrounded by it, a buoyant force develops which is greater than the mass force exerted by the total mass of the closing element. As a result, the closing element is put in the closing position. The closing forces are greater, the larger the dimensions of the float body, because its buoyant force corresponds to the quantity of fuel positively displaced.

One essential advantage of such an embodiment is also that a reliable sealing function of the closing element is thus attained, even if the sealing seat is dirty, since the buoyancy of the float body increases the sealing force, and the closing element is thus sealed off even better.

The closing element is preferably embodied as a flap or umbrella valve, whose sealing function and closing function are decoupled by the fuel level-dependent positioning controlled by the float body. The term "decoupled" should be understood in this context to mean on the one hand that the buildup of a static pressure from an adequately large quantity of fuel placed in the supply container does not actuate the closing element, and on the other that by the dimensioning of the float body, with the closing element already closed, as a consequence of the buoyancy of the float body located in the fuel, the sealing function of the closing element can be increased still further, if only the float body is dimensioned as large enough, thus making its buoyancy correspondingly great enough.

In further exemplary embodiments, the float body is either secured directly in the closing element or is connected to the closing element via a lever, which is supported between the closing element and the float body. A substantial advantage of a float body connected directly to the closing element is that the entire closing element is structurally especially simple and thus functions reliably, especially in a failsafe manner. The substantial advantage of a closing element in which the float body is connected to the actual closing element via a lever is that by a suitable choice of the lever length and the position of the float body, which is preferably disposed displaceably on the lever in the direction of the longitudinal axis of the lever, is that the closing moment in particular and thus the sealing force of the closing element, embodied as an umbrella valve, can be designed to be settable.

The closing element is preferably disposed on the bottom of the suction container in such a way that the umbrella of the umbrella valve is disposed on the outside of the bottom of the suction container, that is, the outside oriented toward the bottom of the supply container, while the float body is disposed in the interior of the suction container. However, it is also possible to dispose the closing element in the region of the bottom of the suction container, on its side wall, in which case the actuation of the closing element takes place via a float body connected to the closing element by a deflection lever.

Along with the use of a size of the float body adapted to the particular location and desired sealing force of the closing element, it is also possible to provide an electromagnet, for instance, as the actuating element, the electromagnet being controlled as a function of the fuel level. For detecting the fuel level, in such a case, fuel fill level sensors of a type known per se should be provided. An actuating device of this kind has the advantage that the closing element is completely decoupled from the fuel level or from the quantity of fuel introduced.

DRAWING

Figure 2:
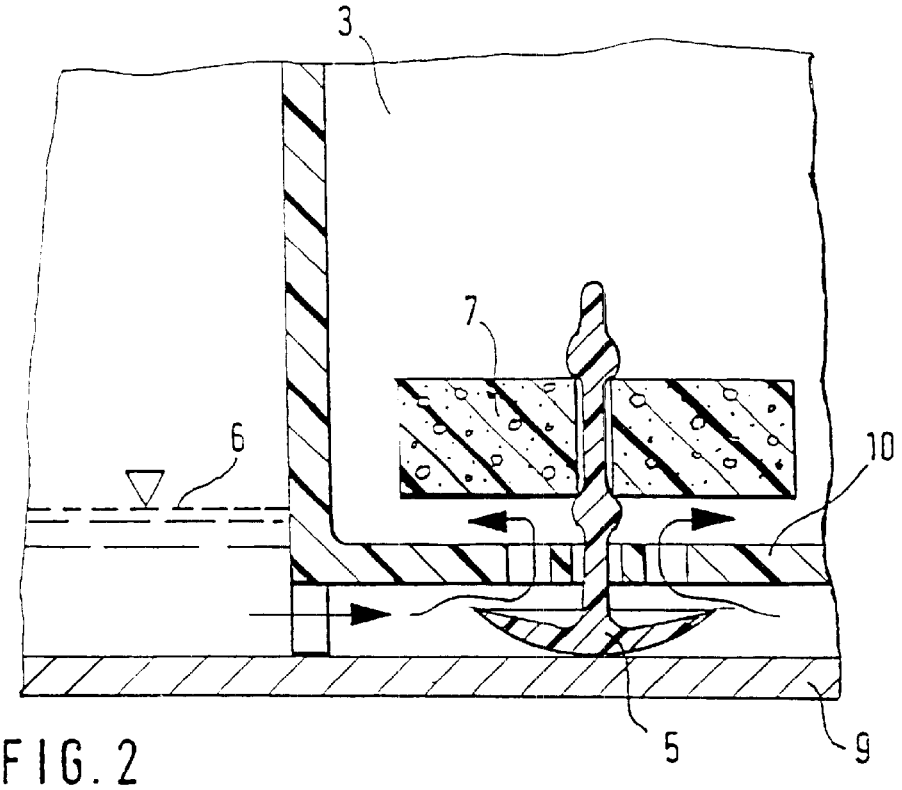
Figure 3:
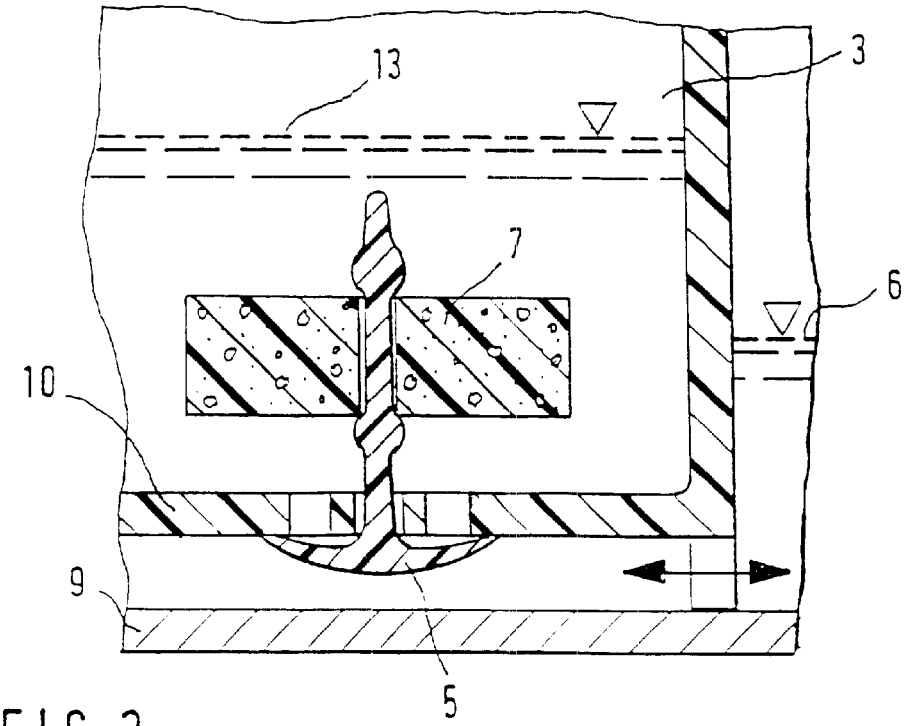
Figure 4:
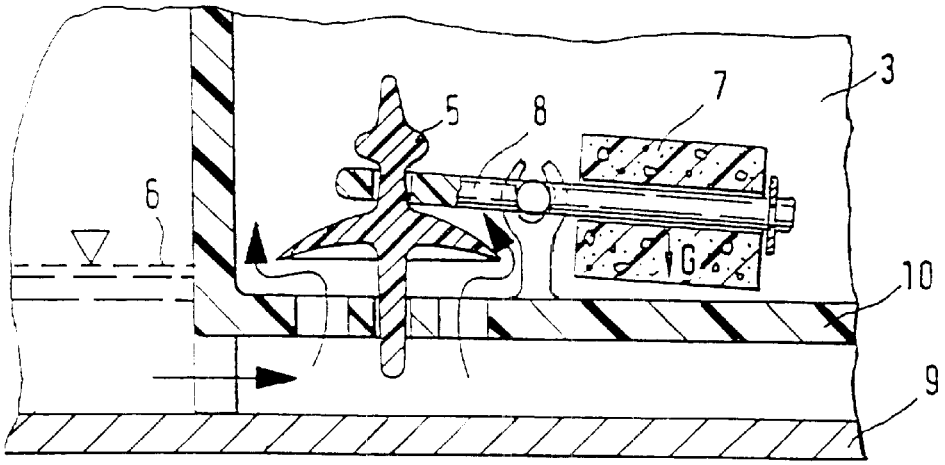

Further advantages, characteristics and possible applications of the invention will now be explained in further detail, in conjunction with the accompanying drawings, in terms of exemplary embodiments. Shown are:

FIG. 1, a fuel feed module with an initial-fill valve according to the prior art;

FIG. 2, the detail of the initial-fill valve of the fuel feed module of the invention, in the open position;

FIG. 3, a view corresponding to FIG. 2 but in the closed position;

FIG. 4, a further exemplary embodiment of the invention in the form of a detail of the fuel feed module with an initial-fill valve in the open position;

and

Figure 5:
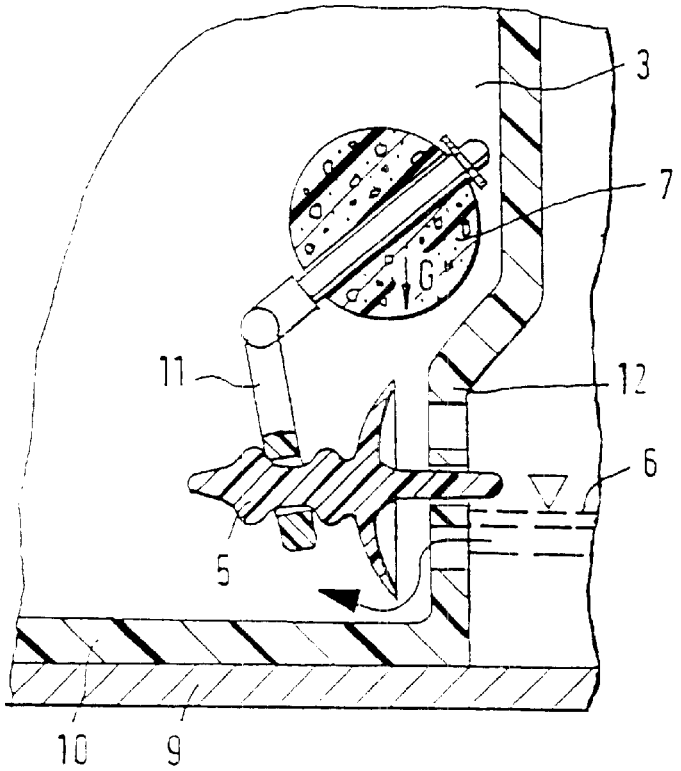

FIG. 5, a further exemplary embodiment of a fuel feed module of the invention with the initial-fill valve open.

EXEMPLARY EMBODIMENT

In FIG. 1, a basic sectional view of a fuel feed module with an initial-fill valve of the kind known in the prior art is shown. A fuel feed module of this kind, which is disposed in a supply container 1 or fuel tank, has a suction container 3, from which a fuel feed unit 2 delivers the fuel, via a suitable fuel line, to an internal combustion engine of a motor vehicle. The excess fuel from the engine flows back to the fuel feed module again via a return line 4. The return line 4 communicates with a jet pump 16, which in a state in which the pump is immersed in the fuel in the supply container 1 feeds fuel by the ejector principle with its propellant stream into the interior of the suction container 3, via a mixing region 17 and an opening. The fuel that has reached the suction container 3 is then delivered to the fuel feed unit 2 via filters 14 and 15.

Once the final assembly has been completed, when the fuel tank 1 is filled it must be assured that a certain quantity of fuel reaches the interior of the suction container 3, so that the fuel feed unit 2 will be at all able to deliver fuel to the engine. To that end, fuel is first introduced into the fuel tank 1. A closing element 5 disposed on the bottom of the suction container 3 covers an opening in this bottom by its own weight. Not until the fuel level 6 in the fuel tank 1 is high enough that an adequate static pressure is built up does the closing element 5 open, thus enabling fuel from the fuel tank 1 to reach the interior of the suction container 3. When in normal operation the suction container 3 is filled with fuel, the closing element 5 is also pressed against the opening in the bottom of the suction container as a consequence of the static pressure thus acting on the closing element 5, and thus seals off the opening, so that fuel from the suction container 3, if its fuel level 13 (see FIG. 3) is above the fuel level 6 in the fuel tank 1, prevents a return flow into the fuel tank 1, or in other: words prevents the suction container 3 from running empty. For opening the closing element 5, in the case of a fuel feed module according to the prior art, a relatively large quantity of fuel in the fuel tank 1 is accordingly required.

In FIG. 2, a detail view of the region of the fuel feed module of the invention is shown, in which the closing element or the initial-fill valve is disposed. The closing element 5 is shown in the open position. A float body 7 is disposed directly on a shaft of the closing element 5, on the end of which an umbrella-shaped or mushroom-shaped head is disposed on the outside of the bottom 10 of the suction container 3. The diameter of the umbrella or head is selected such that the closing element, in the closed state, covers openings in the bottom 10. When the fuel tank 1 is empty or has an only very slight fuel level 6, and when accordingly the float body 7 in the interior of the suction container 3 is not surrounded by fuel, the closing element is moved into the open position by the mass force, as a consequence of the total mass of the closing element (mass of the float body+ mass of the actual closing element itself). The bottom 10 of the suction container 3 is spaced apart from the bottom 9 of the fuel tank 1. The spacing between the bottom 9 and the bottom 10 defines the maximum stroke that the closing element 5 is capable of executing from the fully open position to the closed position. In the open position shown, it is thus possible for even slight quantities of fuel introduced into the fuel tank 1 to flow into the suction container 3 through the openings in its bottom 10, and from the suction container, these quantities can be delivered to the engine by means of the fuel feed unit, not shown in FIG. 2. Mounting the float body 7 directly on the shaft of the closing element 5 represents a structurally especially simple way of achieving this.

In FIG. 3, the region of the fuel feed module of the invention in FIG. 2 is shown, in which there is a fuel level 13 in the interior of the suction container 3 such that the float body 7 is completely surrounded by fuel. Because of the buoyant force thus developed, the closing element is lifted, and the umbrella on the outer side of the bottom 10 of the suction container 3 is raised into a closed, sealing position, spanning the openings in the bottom 10. As long as the fuel level 13 is high enough for the float body 7 to be surrounded by fuel, the initial-fill valve thus remains closed, and a return flow of fuel out of the suction container 3 into the fuel tank 1 when the initial-fill valve is open, via the openings disposed in the bottom 10 of the suction container, is prevented.

In FIG. 4, a further exemplary embodiment of the invention is shown. Once again, the closing element is shown in the form of an umbrella valve, whose umbrella, in the closed position, spans the openings in the bottom 10 of the suction container 3. FIG. 4 shows the open position of the initial-fill valve. The float body 7 is connected to the actual closing element 5 via a lever 8. The lever 8 is supported in a region between the closing element 5 and the float body 7. The bearing position of the lever and the position of the float body on the lever are preferably variable, so that the leverage, which in the case of the fuel level-dictated effect of the buoyancy by means of the float body 7 determines the contact pressure and thus the sealing force of the umbrella valve in the interior of the bottom 7 of the suction container 3, is settable or preselectable.

If, as is the case shown in FIG. 4, the first time the fuel tank 1 is filled there is still no fuel in the suction container 3 of the fuel feed module, the weight of the float body 7 itself, which in combination with the selected leverage develops a greater force than the mass force of the actual closing element, keeps the closing element in the open position. As result, when even only relatively slight quantities of fuel are present in the fuel tank 1, fuel can flow into the interior of the suction container 3 through the openings in its bottom 10. If there is enough fuel in the interior of the suction container 3, the float body 7 floats upward in this fuel, and as a result the openings in the bottom 10 are closed again by means of the umbrella valve.

In FIG. 5, a further exemplary embodiment of the invention is shown, in which the closing element is disposed in the bottom region of the fuel feed module, in the side wall 12 of the suction container 3. The float body 7 is connected to the actual umbrella valve body by means of a deflection lever or bell crank 11. Because of the angle formed by the two legs of the deflection lever 11 and the corresponding deflection of one leg thereof against the actual closing element body, the closing element is kept in the open position in the absence of fuel in the suction container 3, or in other words in the absence of a buoyant force of the float body 7. If the float body 7 floats upward as a consequence of the rise in the fuel level 13 in the suction container 3, then the closing element is pressed into the second, or closed position. Depending on the size of the float body 7 and on the fuel level 13 in the suction container 3, a variably strong and thus predeterminable contact pressure or sealing force of the umbrella of the closing element results in the region of the openings in the side wall 12.

What is claimed is:

1. An apparatus for feeding fuel from a supply container (1) to an internal combustion engine of a motor vehicle, having a fuel feed unit (2) which on the intake side communicates with a suction container (3), communicating with the supply container (1), and on the pressure side communicates with the engine, and having a return line (4) for feeding excess fuel into the suction container (3), which in the bottom region has a closing element (5) that is movable between a first position, in which the suction container (3) is opened relative to the supply container (1), and a second position, in which the suction container (3) is closed relative to the supply container (1), characterized in that the closing element (5) has an actuating device, which is a float body and which in particular at a low or zero fuel level (6) in the supply container (1) keeps the closing element (5) in the first, open position, and which, when at least enough fuel is located in the suction container (3) that the fuel feed unit (2) can still furnish enough fuel to the engine, keeps the closing element (5) in the second, closed position in that the actuating device is a float body (7).

2. The apparatus of claim 1, characterized in that the closing element (5) is embodied as a flap valve or umbrella valve, whose sealing and closing functions are decoupled.

3. The apparatus of claim 1, characterized in that the float body (7) is secured directly to the closing element (5).

4. The apparatus of claim 1, characterized in that the float body (7) is connected to the closing element (5) via a lever (8) supported between the closing element (5) and the float body (7).

5. The apparatus of claim 3, characterized in that the closing element (5) is disposed on the bottom of the suction container (3).

6. The apparatus of claim 1, characterized in that the float body (7) communicates with the closing element (5) via a deflection lever (11).

7. The apparatus of claim 6, characterized in that the closing element (5) is disposed in a side wall (12) of the suction container (3).

* * * * *